United States Patent [19]

Julian

[11] 4,149,646

[45] Apr. 17, 1979

[54] CHILD-RESISTANT LOCKING MEANS FOR A CONTAINER

[75] Inventor: Randall K. Julian, Elberfeld, Ind.

[73] Assignee: Sunbeam Plastics Corporation, Evansville, Ind.

[21] Appl. No.: 917,451

[22] Filed: Jun. 21, 1978

[51] Int. Cl.[2] ..... B65D 55/02; B65D 85/56; A61J 1/00

[52] U.S. Cl. ..... 215/216

[58] Field of Search ..... 215/216, 217, 219, 220, 215/320

[56] References Cited

U.S. PATENT DOCUMENTS

| | | | |
|---|---|---|---|
| 3,770,153 | 11/1973 | Gach | 215/216 |
| 3,949,893 | 4/1976 | Uhlig | 215/216 |
| 3,958,708 | 5/1976 | Le Brun, Jr. | 215/216 |
| 3,989,152 | 11/1976 | Julian | 215/216 |
| 3,993,208 | 11/1976 | Ostrowsky | 215/216 |

*Primary Examiner*—George T. Hall

*Attorney, Agent, or Firm*—Henry K. Leonard

[57] ABSTRACT

Child-resistant locking means for a container having a threaded neck and a closure therefor. The closure has an inner threaded skirt and an outer more flexible skirt on the lower margin of which there is at least one axially extending, depending lug. The container has an abutment near, but spaced radially from, the base of the neck. The abutment has a face that lies in a radial plane of the container and an outer surface that extends inwardly from the outer edge of the abutment face angularly across the normal circular path of the closure lug. When the closure is turned onto the container neck, the lug (1) engages the outer surface of the lug and is flexed outwardly thereby, (2) snaps inwardly after it is turned beyond the abutment and (3) engages the radial face of the abutment when the closure is turned in a retrograde direction. In order to remove the closure, the outer skirt and the tab manually are squeezed inwardly so as to pass the abutment.

6 Claims, 5 Drawing Figures

CHILD-RESISTANT LOCKING MEANS FOR A CONTAINER

BACKGROUND OF THE INVENTION

Because of the emphasis now being placed upon child-resistant containers for dangerous substances such as drugs, household cleaners, poisons, and the like, many suggestions of combinations of containers and closures have been made in the past. Some of these combinations have utilized one-piece closures and special neck finishes on the containers so that the two have cooperating parts which render them child-resistant. Of the many types suggested, several have used axially depending or radially extending tabs on the margins of the closure which cooperate with abutments formed on the necks or the bodies of the containers adjacent the necks.

U.S. Pat. No. 3,770,153 to Gach et al. discloses a child-resistant closure of the "squeeze and turn" type in which the closure skirt has depending tabs and the container neck has abutments or recesses beyond which the tabs are positioned when the closure is turned fully on to the container. In order to remove the closure, it is necessary to squeeze the closure skirt along a diametric line normal to the diameter connecting the tabs to flex the skirt and the tabs outwardly so that the user can turn the closure in a retrograde direction and the tabs will pass the abutments which otherwise prevent removal of the closure.

In my earlier U.S. Pat. No. 3,989,152 and in Ostrowsky U.S. Pat. No. 3,993,208 the child-resistant combinations comprise tabs on the skirt of the closure and abutments on the container shoulder and they are so designed that the tabs pass on the inner sides of the abutments both when the closure is turned on to the container and when it is to be removed.

Experience has taught that it is preferable from a user's standpoint to provide for squeezing the closure skirt at the points and along the diameter actually connecting the tabs rather than along a diameter at 90° from that connecting the tabs. Thus the manner of opening closures according to my earlier patent and the Ostrowsky patent disclosed above, may be more readily perceived and understood by users of sufficient age to be able to read the instruction legends which usually are molded into the top surfaces of such closures.

However, when the closure skirt has to be squeezed inwardly both when turning the closure onto and off of the container, repeated removals and replacements tend to give the plastic skirt a "set" in the inward direction thereby lessening its child resistance.

It is therefore, the principal object of the instant invention to provide a squeeze and turn child-resistant closure for use on and in combination with the threaded neck of a container which has one or more abutments on its shoulder near the neck but which provides that the locking tabs will pass on the radially outward side of the abutments when the closure is turned onto the container and which requires that these tabs be squeezed inwardly in order to remove the closure from the container.

DESCRIPTION OF PREFERRED ENBODIMENT

Figure 1:
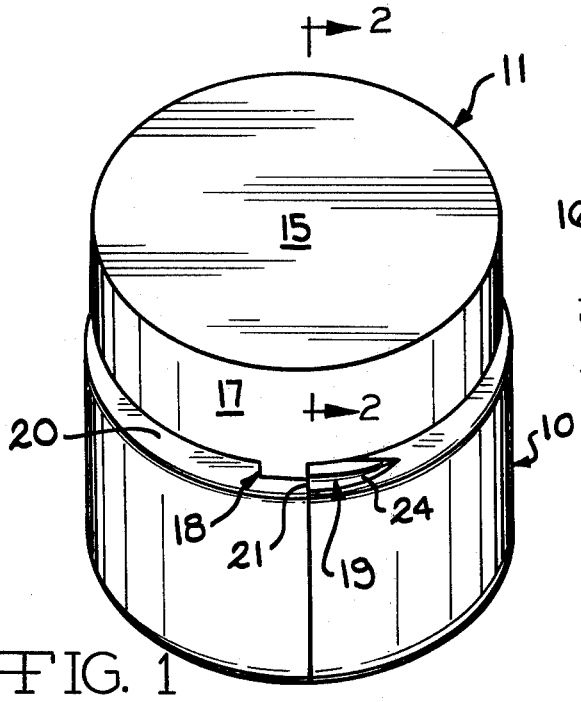
FIG. 1 is a view in perspective of a closure and container body according to the instant invention.
Figure 2:
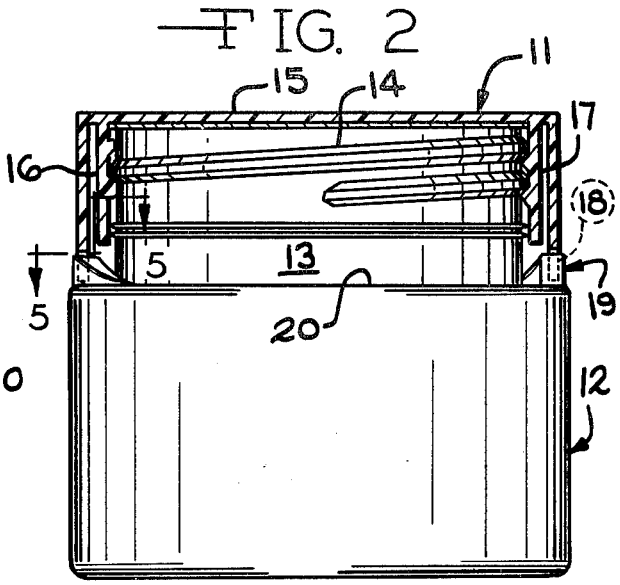
FIG. 2 is a vertical sectional view partly in elevation taken along the line 2—2 of FIG. 1.

Child-resistant locking means embodying the invention are illustrated as being a part of a container 10 and a closure 11. The container 10 has a body 12 and a neck 13 which is provided with threads 14. The closure 11 is generally of inverted cup-shape, consisting of a disk-like top 15, a threaded inner skirt 16 and a relatively more flexible outer skirt 17.

The outer skirt 17 has a pair of diametrically positioned, depending tabs 18 which extend downwardly into interengaging alignment with a pair of abutments 19 located on a shoulder 20 of the container 10.

Each of the abutments 19 has a face 21 which lies, at least substantially, in a radial plane of the container 10 and closure 11 and in the plane of the mold parting line 22 of the container 10. Each of the abutments 19 has an inner surface 23 which is spaced away from the outer surface of the neck 13 so that the associated one of the tabs 18 can pass between the inner surface 23 and the neck 13. Each of the abutments also has an outer surface 24 which extends from the outer edge of the face 21 and is curved inwardly toward the neck 13 as best can be seen in FIG. 5.

The lower end of each of the tabs 18 preferably has a beveled edge 25 so that when it engages the outer surface 24 of the abutment 19 the reaction assuredly will deflect the tab 18 outwardly.

If the container 10 is utilized for liquid materials, the closure 11 will be provided with a conventional liner 26, or similar sealing means, and the neck 13 may have one or more annular, sharp-edged ribs 27 which are engaged by the inner surface of the lower portion of the threaded skirt 16 to assist in sealing the container.

Figure 3:
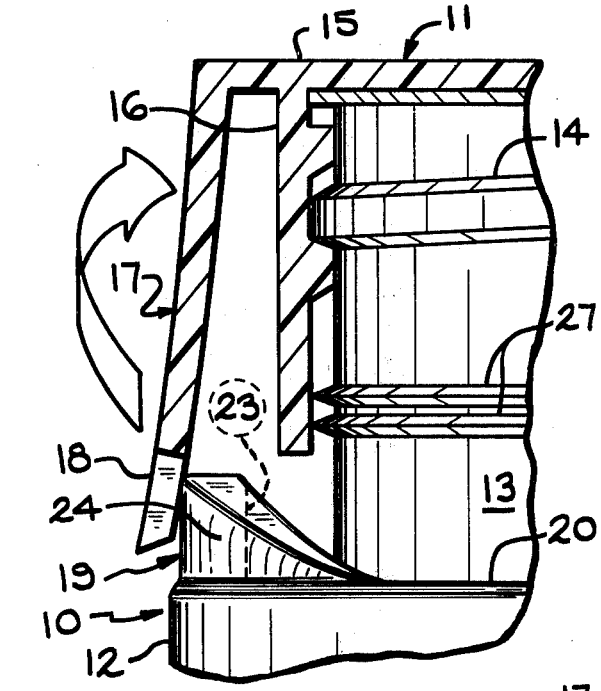
FIG. 3 is a greatly enlarged, fragmentary, vertical sectional view of the upper left hand portion of FIG. 2 illustrating how the tab carrying outer skirt of the closure passes on the outer side of the container abutment when the closure is turned onto the container.
Figure 4:
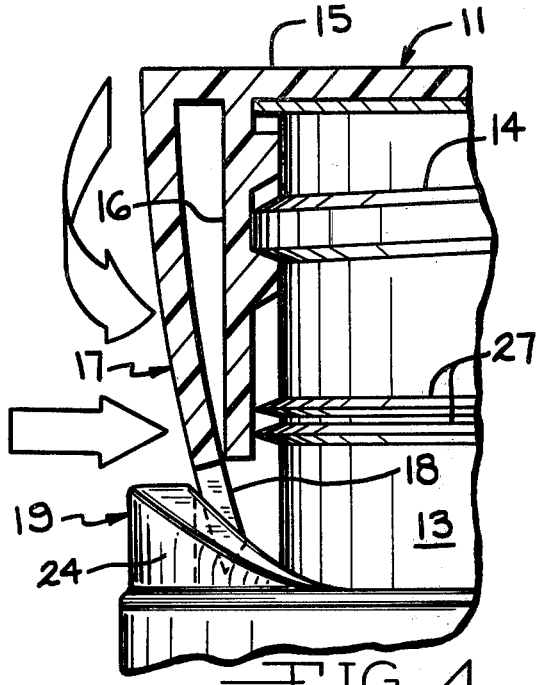
FIG. 4 is a view similar to FIG. 3 and illustrating how the outer skirt of the closure is squeezed inwardly in order that the tabs thereon will pass the inner side of the container abutment when it is desired to remove the closure from the container.
Figure 5:
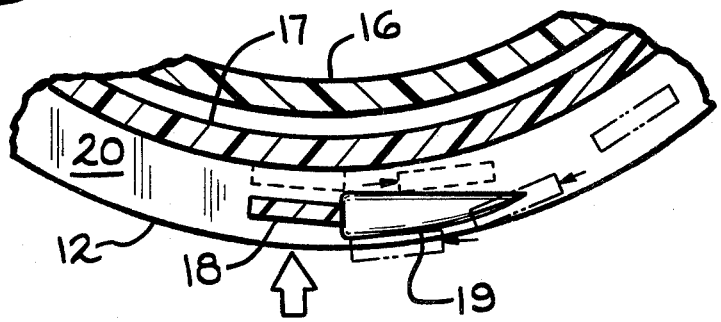
FIG. 5 is a greatly enlarged, fragmentary horizontal sectional view taken along the line 5—5 of FIG. 2

As can best be seen in FIG. 5, when the closure 11 is turned onto the container 10, either by a capping machine or by a user replacing the closure 11, the tabs 18 engage the outer surface 24 of the abutment 19 and are cammed outwardly thereby, flexing the outer skirt 17. No specific action is required on the part of the user and no special attachment required on the capping machine when the closure 11 is turned on to the container neck 13. When an adult or a child of more than tender years desires to remove the closure 11, he presses inwardly against the skirt 17, as illustrated by the arrow in FIG. 3, flexing the tabs 18 inwardly so that they pass through the space between the inner surface 23 of the abutment 19 and the container neck 13.

The outward flexing of the closure skirt when it is turned onto the container is balanced by the inward flexing required in order to remove the closure. As a result the closure skirt does not take a "set" even after repeated removals and replacements and the closure tabs 18 are more likely to remain in alignment with the abutments 19 as illustrated in FIG. 5.

Having described my invention, I claim

1. Child-resistant locking means for a container having a tubular neck with a neck finish for a twist-action cap, said means consisting of, (a) an abutment on said container, said abutment being spaced radially outwardly from the outer side of said neck and having (1) a face lying substantially in a radial plane of said neck and (2) an outer side extending from the outer edge of said face in a retrograde direction and angled inwardly therefrom, and (b) a deflectable tab on said cap, said tab having a portion that normally extends radially outwardly into a position of engagement with said face of said abutment and that is movable outwardly relative to said face by engagement with said outer side of said abutment when said cap is twisted onto said container neck to closed position and by manual inward deflection prior to retrograde rotation of said cap from closed position.

2. Child-resistant locking means according to claim 1 in which the tab extends axially from the cap.

3. Child-resistant locking means according to claim 1 in which the cap has an annular skirt and the locking tab is an axial projection at the lower extremity of said skirt.

4. Child-resistant locking means according to claim 1 in which the container neck and the cap have cooperating mating threads on their outer and inner surfaces, respectively.

5. Child-resistant locking means according to claim 4 in which the cap has two concentric skirts, threads on the inner side of the inner skirt and in which the cooperating deflectable tab is on the outer skirt.

6. A child-resistant closure means for a container having a threaded neck, said closure means comprising in combination, (a) an inverted, generally cup-shaped cap having (1) an inner skirt having threads mating with the threads on said container neck, (2) an outer annular skirt, (3) a deflectable locking tab axially projecting from said outer skirt, (b) an abutment on said container that is radially spaced from the outer side of said container neck, that has a stop-face lying at least generally in a radial plane of said container neck, that has an outer surface extending angularly inwardly from the outer edge of said stop-face and that is located for engagement by said tab for preventing retrograde rotation of said cap after said cap has been turned onto said container neck to a relative angular position with said tab beyond said abutment face.

* * * * *